US009885350B2

(12) United States Patent
Bacha et al.

(10) Patent No.: US 9,885,350 B2
(45) Date of Patent: Feb. 6, 2018

(54) WATER PUMP CONTROL SYSTEM

(71) Applicant: Federal Signal Corporation, Oak Brook, IL (US)

(72) Inventors: Benjamin Bacha, Streator, IL (US); Kevin Silovich, Ottawa, IL (US); Benjamen Schmitt, Oglesby, IL (US)

(73) Assignee: Federal Signal Corporation, Oak Brook, IL (US)

( * ) Notice: Subject to any disclaimer, the term of this patent is extended or adjusted under 35 U.S.C. 154(b) by 0 days.

(21) Appl. No.: 15/043,662

(22) Filed: Feb. 15, 2016

(65) Prior Publication Data

US 2016/0245272 A1 Aug. 25, 2016

Related U.S. Application Data

(60) Provisional application No. 62/275,950, filed on Jan. 7, 2016, provisional application No. 62/118,619, filed on Feb. 20, 2015.

(51) Int. Cl.
*F04B 49/00* (2006.01)
*F04B 49/22* (2006.01)
(Continued)

(52) U.S. Cl.
CPC ..... *F04B 49/002* (2013.01); *E02F 3/8816* (2013.01); *E02F 3/925* (2013.01); *E02F 3/9206* (2013.01); *F04B 23/02* (2013.01); *F04B 23/06* (2013.01); *F04B 49/08* (2013.01); *F04B 49/20* (2013.01); *F04B 49/22* (2013.01); *F04B 2203/0201* (2013.01)

(58) Field of Classification Search
CPC ..... E02F 3/925; E02F 3/8816; E02F 3/8891; E02F 3/88; E02F 5/003; E02F 5/226; E02F 3/9206; E21B 21/065; F04D 15/0209; F04D 49/002; F04D 49/22; F04D 49/08; F04D 49/20; F04D 23/02; F04D 23/06
USPC ..... 37/309, 317, 322, 323, 318, 344, 347, 37/348; 175/66; 417/22, 43, 141
See application file for complete search history.

(56) References Cited

U.S. PATENT DOCUMENTS 5,295,317 A * 3/1994 Perrott ..... E02F 3/925 175/66
6,386,224 B2 * 5/2002 Takura ..... E03B 7/02 137/255

(Continued)

OTHER PUBLICATIONS

Vactor® HXX Vacuum Excavators brochure, Vactor Manufacturing, 6 pages (Copyright 2012).

*Primary Examiner* — Robert E Pezzuto
(74) *Attorney, Agent, or Firm* — Merchant & Gould P.C.

(57) ABSTRACT

A water pump control system is provided for vacuum excavation equipment. The water pump control system includes a control circuit for controlling a hydraulic actuation circuit configured to control a water pump circuit such that a water pressure produced by the water pump circuit does not exceed a desired water pressure. The hydraulic actuation circuit can include a proportional hydraulic valve, and the control circuit controls a water pump speed by monitoring a water pressure and adjusting an electric current flowing into the proportional valve to meet the desired water pressure. The control circuit can include a pressure transducer mounted to the water pump circuit to monitor the water pressure in real-time.

11 Claims, 11 Drawing Sheets

(51) Int. Cl.

| | |
|---|---|
| ***E02F 3/88*** | (2006.01) |
| ***E02F 3/92*** | (2006.01) |
| ***F04B 23/02*** | (2006.01) |
| ***F04B 23/06*** | (2006.01) |
| ***F04B 49/08*** | (2006.01) |
| ***F04B 49/20*** | (2006.01) |

(56) References Cited

U.S. PATENT DOCUMENTS

| | | | | |
|---|---|---|---|---|
| 7,182,090 | B2 * | 2/2007 | Abbott | A61H 33/02 134/166 C |
| 7,415,748 | B1 * | 8/2008 | Guhr | E01H 1/0836 15/340.1 |
| 7,484,322 | B2 * | 2/2009 | Maybury, Jr. | E02F 3/8816 175/66 |
| 7,717,353 | B2 * | 5/2010 | Matulis | A01C 23/008 222/135 |
| 7,901,190 | B2 * | 3/2011 | Gray | F04D 15/0209 417/141 |
| 8,341,955 | B2 * | 1/2013 | Brantley | F04B 1/324 417/380 |
| 9,482,220 | B2 * | 11/2016 | Stephens | F04B 49/00 |

* cited by examiner

WATER PUMP CONTROL SYSTEM

CROSS-REFERENCE TO RELATED APPLICATIONS

This application claims the benefit of U.S. patent application Ser. No. 62/275,950, titled WATER PUMP CONTROL SYSTEM, filed Jan. 7, 2016, and U.S. patent application Ser. No. 62/118,619, titled WATER PUMP CONTROL SYSTEM, filed Feb. 20, 2015, the disclosures of which are hereby incorporated by reference in their entireties.

BACKGROUND

Vacuum excavation, which is also referred to as hydro excavation, is a process of excavating a soil with a jet of pressurized water and an air vacuum system. Pressurized water is injected to break up and cut soil while the air vacuum system operates to remove debris to a debris collection tank.

In certain applications, the pressure of discharging water should be limited to a certain level to ensure operators' safety and prevent destruction of underlying infrastructure. Accordingly, vacuum excavation processes typically need to meet guidelines for maximum operating water pressures in different situations. Such guidelines are provided by several organizations, such as Gas Technology Institute (GTI), Occupational Safety and Health Administration (OSHA), and Technical Standards and Safety Authority (TSSA) in Ontario, Canada. Operators of vacuum excavation equipment are required to operate the equipment at a proper water pressure for a given circumstance. Operators are typically responsible for selecting a nozzle connected to a water pump and manipulating a water pump controller to properly set the water pump to a safe water pressure.

SUMMARY

In general terms, this disclosure is directed to a water pump control system. In one possible configuration and by non-limiting example, the water pump control system includes a control circuit for controlling a hydraulic actuation circuit configured to control a water pump circuit such that a water pressure produced by the water pump circuit does not exceed a desired water pressure. Various aspects are described in this disclosure, which include, but are not limited to, the following aspects.

In general, the control circuit operates to receive a desired water pressure from an operator of the system and monitor a water pressure generated by the water pump. The control circuit may operate to compare the desired water pressure and the monitored water pressure to generate the control signal to control the hydraulic actuation circuit, which then adjusts the operation of the water pump circuit. In certain examples, the hydraulic actuation circuit includes a proportional hydraulic valve, and the control circuit controls a water pump speed by monitoring a water pressure and adjusting a control signal (e.g., electric current) flowing into the proportional valve to meet the desired water pressure set by an operator. The control circuit may include a pressure transducer mounted to the water pump circuit to monitor the water pressure in real-time.

The water pump control system in accordance with the present disclosure can eliminate a bypass of water through a water pump unloader to reduce excessive heat in the water system. This results in lower maintenance costs and lower fuel costs. Further, the water pump control system may provide a user-friendly control of a water pressure generated by a water pump for excavating soil, while ensuring safety and preventing damage to underlying infrastructure. The water pump control system in accordance with the present disclosure operates to prevent a water pump circuit from generating a water pressure above a desired water pressure. In certain examples, the water pump control system enables an operator to set the desired water pressure for a given application. As such, the water pump control system in accordance with the present disclosure enables a vacuum excavation system to meet industry safety standards. Further, the water pump control system can increase the life of excavation equipment by preventing an excessive amount of flow that would otherwise be diverted over pressure relief valves commonly used in the vacuum excavation equipment.

One aspect is a method of controlling a water pump. The method may include: receiving a user input of a desired water pressure for the water pump; controlling a hydraulic actuation circuit to actuate the water pump at the desired water pressure; monitoring a water pressure generated by the water pump; comparing the water pressure with the desired water pressure; and if the water pressure is different from the desired water pressure, controlling the hydraulic actuation circuit to operate the water pump to adjust the water pressure to meet the desired water pressure.

Another aspect is a system for controlling a water pump to inject pressurized water. The system may include a hydraulic actuation circuit configured to actuate the water pump, and a control circuit configured to monitor a water pressure generated by the water pump and control the hydraulic actuation circuit. The control unit is configured to control the hydraulic actuation circuit to operate the water pump to adjust the water pressure not to exceed a desired water pressure.

Yet another aspect is a vacuum excavation vehicle. The vehicle may include a water pump circuit configured to produce a jet of pressurized water and inject the pressurized water to soil for excavation, a hydraulic actuation circuit configured to actuate the water pump circuit, and a control circuit configured to receive a desired water pressure and monitor a current water pressure produced by the water pump circuit. The control circuit is configured to control the hydraulic actuation circuit based upon a comparison between the desired water pressure and the current water pressure to adjust the hydraulic actuation circuit to operate the water pump circuit to meet the desired water pressure.

The above features and advantages and other features and advantages of the present teachings are readily apparent from the following detailed description of the best modes for carrying out the present teachings when taken in connection with the accompanying drawings.

BRIEF DESCRIPTION OF THE DRAWINGS

Non-limiting and non-exhaustive embodiments are described with reference to the following figures, which are not necessarily drawn to scale, wherein like reference numerals refer to like parts throughout the various views unless otherwise specified.

DETAILED DESCRIPTION

Figure 1:
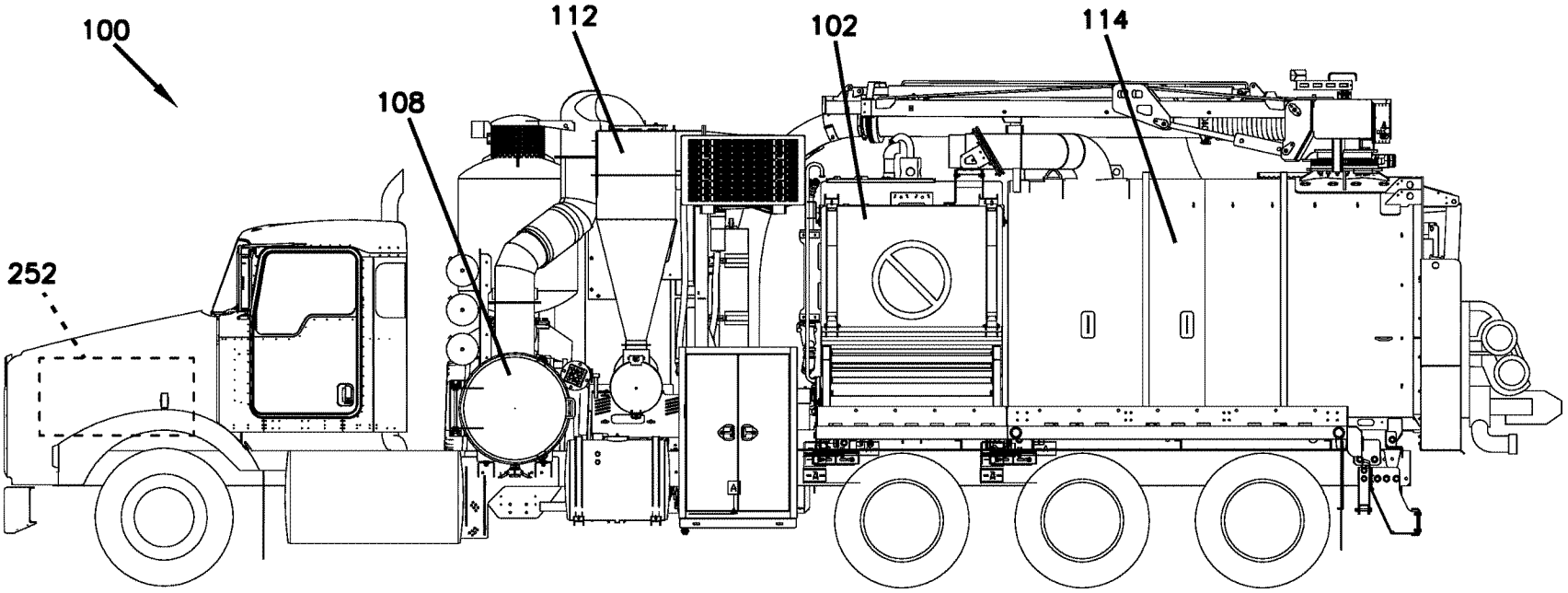
FIG. 1 is a side view of an example vacuum excavation vehicle.

Various embodiments will be described in detail with reference to the drawings, wherein like reference numerals represent like parts and assemblies throughout the several views.

Figure 2:
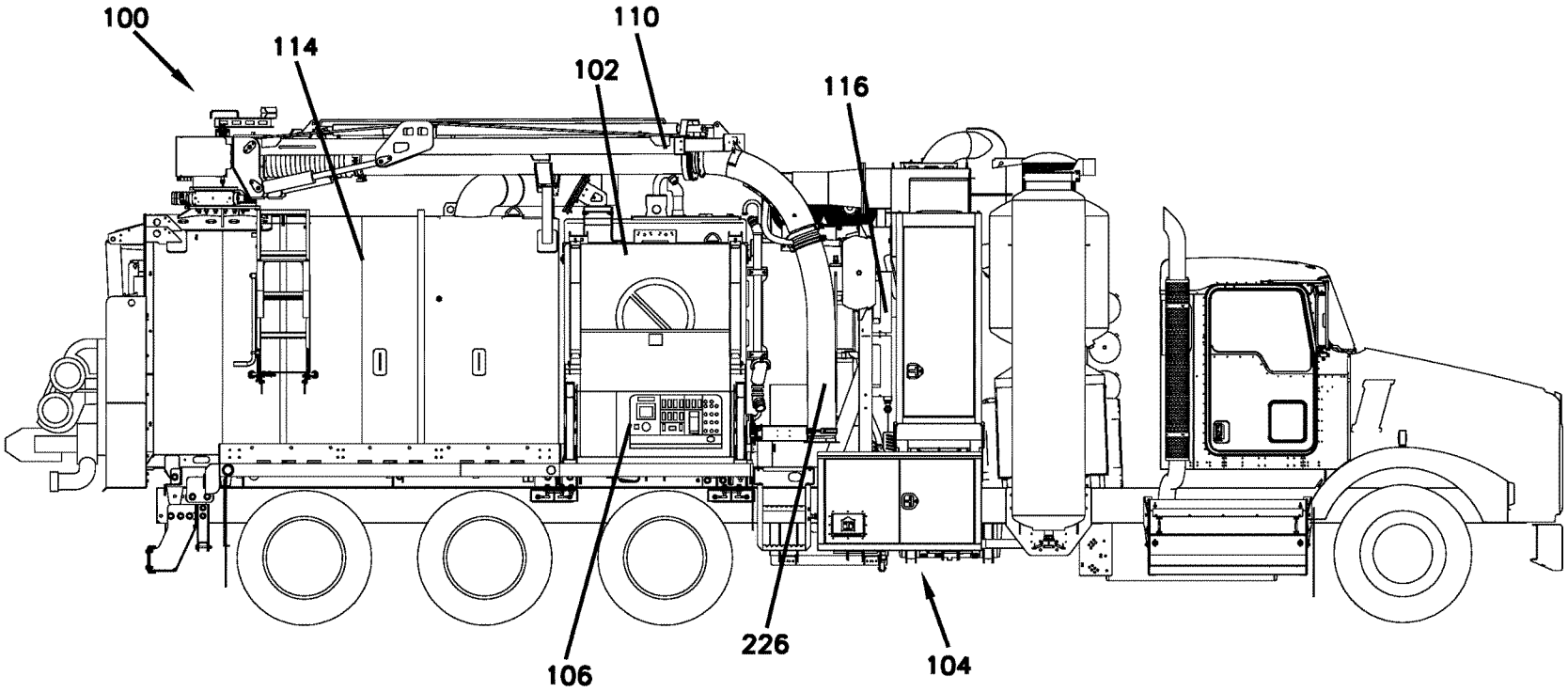
FIG. 2 is another side view of the vacuum excavation vehicle of FIG. 1.
Figure 3:
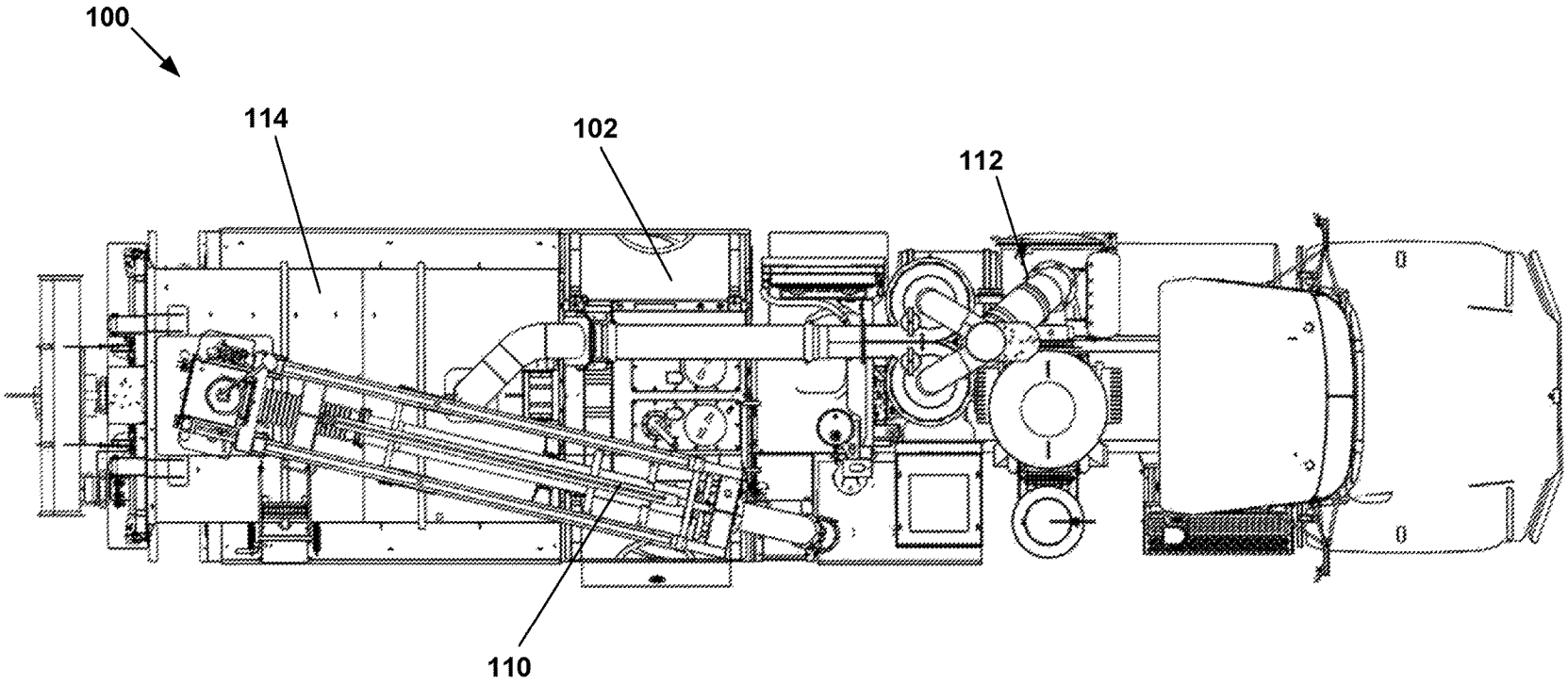
FIG. 3 is a top view of the vacuum excavation vehicle of FIG. 1.

Referring to FIGS. 1-3, an example vacuum excavation vehicle 100 is described, employing a water pump control system in accordance with the present disclosure. FIG. 1 is a side view of an example vacuum excavation vehicle 100, FIG. 2 is another side view of the vacuum excavation vehicle 100 of FIG. 1, and FIG. 3 is a top view of the vacuum excavation vehicle 100 of FIG. 1.

In some embodiments, the vehicle 100 can include a water tank 102, a water pump control system 104, a control panel 106, a fan drive system 108, a boom and vacuum hose 110, a cyclone separator 112, a debris collection tank 114, and a water heating system 116.

The vehicle 100 includes a water pump system for injecting a jet of pressurized water to soil to break it up and remove debris by air suction. As described below, the vehicle 100 is equipped with a water pump circuit 202 (FIG. 4) to generate pressurized water that is then injected for digging soil. The pressurized water provides a working force to break up and cut the soil. One example of the vehicle 100 is Vactor HXX Hydroexcavator available from Vactor Manufacturing, Inc. (Streator, Ill.).

A water tank 102 operates to contain water that flows into a water pump 224 (FIG. 5) that is used to generate pressurized water. The water tank 102 can be made of, for example, polyethylene (HDPE) or stainless steel. In some embodiments, polyethylene is preferable to stainless steel in making the water tank 102 because a polyethylene water tank can retain heat longer than a stainless steel tank, reducing a likelihood of freezing in harsh winter conditions.

A water pump control system 104 operates to control a water pump circuit 202 (FIG. 4) to produce a desired water pressure set by an operator. An example water pump control system 104 is illustrated and described in more detail with reference to FIGS. 4-7.

A control panel 106 is configured to enable an operator to interact with several operative elements in the vehicle 100, such as the water pump control system 104. In the illustrated example, the control panel 106 is contained in a control box that is located curbside of the vehicle 100 for easy access and efficient operation. The control box can be made of aluminum for enhanced protection against environmental elements. The control panel 106 can provide various controls, such as a tachometer and hour meter for various components (e.g., a water pump and a fan), temperature indicators for various systems, a water pump circuit on/off switch, boom and body dump functions, an emergency stop button, and various other controls. The control panel 106 can communicate with a remote controller that is operated by an operator with either wireless or wired connection. In some embodiments, the control panel 106 includes a display screen to display various pieces of information, such as a water pressure of the water pump (e.g., a pressure of pressurized water injected through the hose 110). The control panel 106 includes a user interface 270 as illustrated and described with reference to FIG. 5.

A fan drive system 108 operates to actuate a fan to create a vacuum through the boom and vacuum hose 110 to draw debris into the debris collection tank 114.

A boom and vacuum hose 110 is mounted on the top of the vehicle 100 and rotatable around the vehicle 100. The boom and vacuum hose 110 is also extendable in length to cover a large working area. The boom and vacuum hose 110 has a digging lance 226 at a forward end thereof. An example digging lance 226 is illustrated and described with reference to FIG. 5.

A cyclone separator 112 operates with the fan drive system 108 to filter air, thereby increasing air-routing performance.

A debris collection tank 114 is configured to collect debris through the boom and vacuum hose 110 after the soil is cut and broken down by the pressurized water injected from the boom and vacuum hose 110. In some embodiments, the debris collection tank 114 is made of high strength, low allow Ex-Ten 50 steel with corrosion resistance copper additive for longer component life.

A water heating system 116 operates to preheat water in the water tank 102 in cold weather conditions.

Referring to FIGS. 4-7, an example of the water pump control system 104 is described in more detail.

Figure 4:
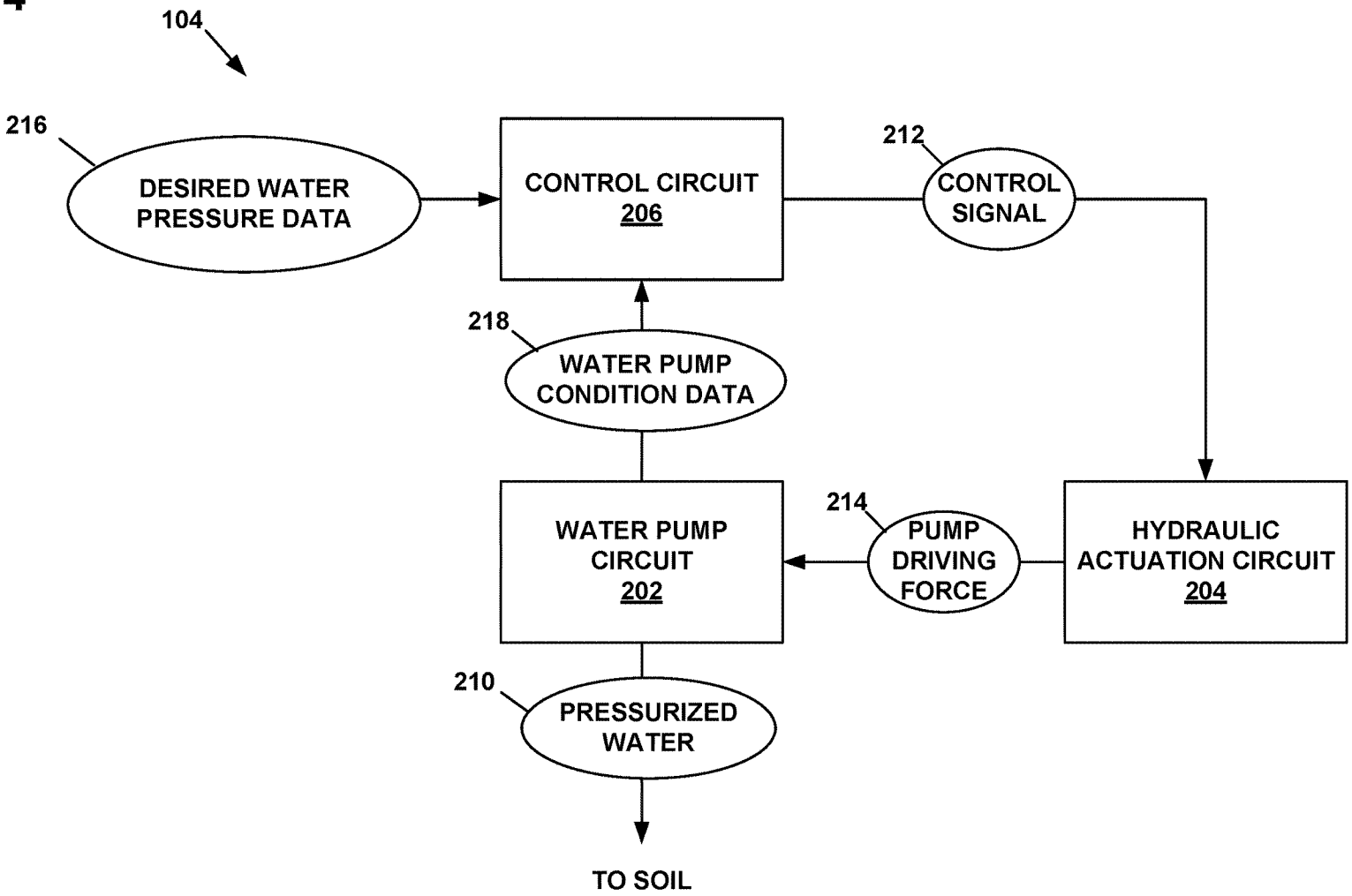
FIG. 4 is a schematic block diagram of a water pump control system of FIG. 1.

FIG. 4 is a schematic block diagram of the water pump control system 104 of FIG. 1. The water pump control system 104 can include a water pump circuit 202, a hydraulic actuation circuit 204, and a control circuit 206.

The water pump circuit 202 operates to produce a jet of pressurized water 210 and inject the pressurized water 210 to soil for excavation. An example water pump circuit 202 is described and illustrated with reference to FIG. 5.

The hydraulic actuation circuit 204 operates to actuate the water pump circuit 202. In some embodiments, the hydraulic actuation circuit 204 operates to receive a control signal 212 from the control circuit 206 and provide a pump driving force 214 to the water pump circuit 202 based upon the control signal 212. An example hydraulic actuation circuit 204 is described and illustrated in more detail with reference to FIG. 5.

The control circuit 206 operates to control the hydraulic actuation circuit 204, which subsequently controls the water pump circuit 202, such that a water pressure produced by the water pump circuit 202 does not exceed a desired water pressure.

In some embodiments, the control circuit 206 operates to receive desired water pressure data 216 from an operator of the system. The desired water pressure data 216 includes information about a desired water pressure produced by the water pump circuit 202. The desired water pressure can be a maximum water pressure for excavation processes that is permitted under a given application. In other embodiments, the data 216 can include a list of desired water pressures for different applications and can be stored in the control circuit 206 so that an operator does not need to independently set up a desired water pressure every time that the system is operated.

The control circuit 206 operates to monitor a status of the water pump circuit 202 and receive water pump condition data 218. The water pump condition data 218 includes information about various conditions of the water pump circuit 202. In some embodiments, the water pump condition data 218 contains information about a water pressure generated by the water pump circuit 202.

The control circuit 206 operates to compare the desired water pressure data 216 and the water pump condition data 218 to generate the control signal 212. When determining a difference between the desired water pressure and the current water pressure, the control circuit 206 generates the control signal 212 to control the hydraulic actuation circuit 204, which, based on the control signal 212, controls the operation of the water pump circuit 202 to adjust the current water pressure to the desired water pressure. An example operation of the control circuit 206 is described and illustrated in more detail with reference to FIG. 6.

Figure 5:
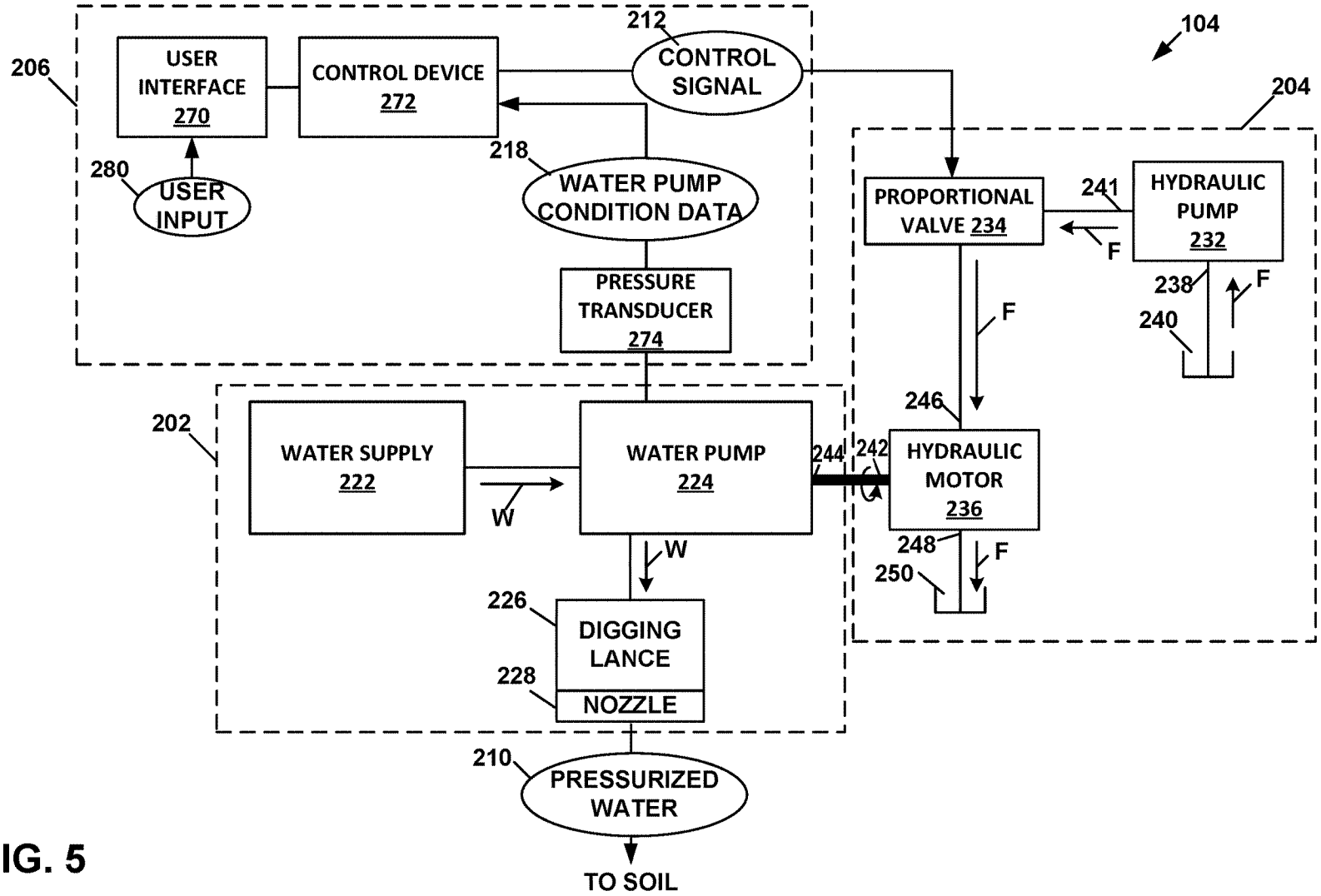
FIG. 5 is a schematic diagram of an example water pump control system of FIG. 4, illustrating example elements of a water pump circuit, a hydraulic actuation circuit, and a control circuit.

FIG. 5 is a schematic diagram of an example water pump control system 104 of FIG. 4, illustrating example elements of the water pump circuit 202, the hydraulic actuation circuit 204, and the control circuit 206.

In some embodiments, the water pump circuit 202 includes a water supply 222, a water pump 224, a digging lance 226, and an injection nozzle 228.

The water supply 222 includes the water tank 102 of the vehicle 100. The water supply 222 contains water (W) and provides it to the water pump 224.

The water pump 224 operates to move water (W) from the water supply 222 to the digging lance 226. The water pump 224 can be of various types, such as plunger type water pumps. The water pump 224 is actuated by the pump driving force 214 generated by the hydraulic actuation circuit 204. In this example, the water pump 224 is operated by mechanical action (e.g., torque) generated by a hydraulic motor 236 included in the hydraulic actuation circuit 204. In some embodiments, the water pump 224 is configured to generate a water flow rate from 0 to 35 GPM. An input speed of the water pump 224 and a nozzle size can determine a water flow and pressure of the water pump 224. As described herein, the control circuit 206 operates to control the water pump speed by monitoring the water pressure and adjusting the control signal 212 (e.g., electric current) flowing into the proportional valve 234 to meet the desired water pressure set by an operator.

The digging lance 226 is attached at the forward end of the boom and vacuum hose 110 and configured to be placed on soil to be broken up and cut.

The injection nozzle 228 is attached to an end of the digging lance 226 and configured to build up a pressure of water therein until a jet of pressurized water 210 is produced and discharged therethrough.

With continued reference to FIG. 5, the hydraulic actuation circuit 204 includes a hydraulic pump 232, a proportional hydraulic valve 234, and a hydraulic motor 236.

The hydraulic pump 232 is a mechanical source of power in the hydraulic actuation circuit 204 and converts mechanical power into hydraulic energy. In some embodiments, the hydraulic pump 232 is a power take-off (PTO) driven hydraulic pump. For example, the hydraulic pump 232 can have an input shaft that may be driven by, for example, a primary power plant or engine 252 (FIG. 1) of the vehicle 100 and/or an auxiliary power plant or engine. The hydraulic pump 232 includes an inlet port 238 and an outlet port 241. The inlet port 238 is connected to a first reservoir 240, and the outlet port 241 is connected to the proportional hydraulic valve 234. When the hydraulic pump 232 is in operation (i.e., as the input shaft of the hydraulic pump 232 is rotated), hydraulic fluid (F) is drawn from the first reservoir 240 through the inlet port 238 and discharged to the proportional hydraulic valve 234 through the outlet port 241. The hydraulic pump 232 can be of various types, such as variable displacement pumps and positive displacement pumps.

The proportional hydraulic valve 234 operates to provide hydraulic fluid (F) to the hydraulic motor 236. The proportional hydraulic valve 234 is configured to change an output (e.g., a volume or rate of flow) of hydraulic fluid (F) proportionally to an input of the control signal 212. As a result, the hydraulic motor 236, and thus the water pump 224, are operated based ultimately upon the control signal 212. In some embodiments, the proportional hydraulic valve 234 is configured as a proportional hydraulic flow control valve. In some embodiments, the control signal 212 is an electric current, and the proportional hydraulic valve 234 is configured to change an output flow rate of hydraulic fluid (F) proportionally to the electric current (i.e., the control signal 212) flowing thereto. The proportional hydraulic valve 234 is also referred to herein as an electro-proportional compensator.

The hydraulic motor 236 is mechanically coupled to the water pump 224 and actuates the water pump 224. The hydraulic motor 236 is a mechanical actuator that converts pressure and flow of hydraulic fluid (F) into torque and angular displacement (i.e., rotation). The hydraulic motor 236 has an output shaft 242 that is directly coupled to an input shaft 244 of the water pump 224. The hydraulic motor 236 has an inlet port 246 for receiving hydraulic fluid (F) from the hydraulic pump 232 through the proportional hydraulic valve 234, and an outlet port 248 for discharging the hydraulic fluid (F) to a second reservoir 250. As the hydraulic fluid (F) passes from the inlet port 246 to the outlet port 248, the hydraulic motor 236 generates the pump driving force 214 and delivers the force 214 to the water pump 224 through the output shaft 242 of the hydraulic motor 236 and the input shaft 244 of the water pump 224. The hydraulic pump 232 can be of various types, such as variable displacement motors and positive displacement motors.

Although the first reservoir 240 and the second reservoir 250 are separately provided in the illustrate example, the first and second reservoirs 240 and 250 can share a common reservoir, thereby defining a closed loop hydraulic circuit.

With continued reference to FIG. 5, the control circuit 206 can include a user interface 270, a control device 272, and a pressure transducer 274. The control circuit 206 can be retrofitted to any water pump control system 104 employing the water pump circuit 202 and the hydraulic actuation circuit 204.

The user interface 270 provides an interface for an operator to interact with the control device 272. In some embodiments, the user interface 270 is included in the control panel 106 of the vehicle 100. The user interface 270 is configured to receive a user input 280 from the operator to manage the control device 272. The user interface 270 can be configured in various manners, such as switches, buttons, adjustable knobs, and keypads. In other embodiments, the user interface 270 can be configured at least partially as a touch-sensitive screen. The user interface 270 can also include a screen for displaying various pieces of information about the water pump control system 104 to an operator. For example, such information can include a status of the water pump 224 (e.g., a flow rate or pressure at the water pump 224), a water level of the water supply 222, information about the user input 280, and other information relating to the operation of the water pump control system 104.

The user interface 270 is configured to allow an operator to set a maximum working water pressure (e.g., a desired water pressure) to meet required pressure limitations per industrial practices or facility requirements. Such a maximum water pressure (e.g., a desired water pressure) provides an upper limit of a water pressure and is used to control a water pressure output of the water pump 224. In some embodiments, the control device 272 can have one or more default setting of water pressure limitations based upon industrial practices for various circumstances. Such default settings can be custom-configurable to tailor specific requirements.

In some embodiments, the user interface 270 can provide a flow control switch configured to enable an operator to select any pressure up to the maximum working water pressure (e.g., the desired water pressure) either set by the operator or by default. In some embodiments, the control circuit 206 is configured such that a click (either single or double click) on the flow control switch of the user interface 270 leads the water pump 224 to the maximum working water pressure (e.g., the desired water pressure). In other embodiments, the control circuit 206 is configured such that a click (either single or double click) on the flow control switch of the user interface 270 leads the water pump 224 to a water pressure selected by the operator that is lower than the maximum working water pressure (e.g., the desired water pressure).

In some embodiments, the user input 280 includes a water pump control command and a desired water pressure. The water pump control command can include a power on/off command for switching on or off the water pump control system 104 (including the water pump 224). For example, the user interface 270 provides a two-way switch or a button (either mechanical or on a touch-sensitive display screen) that enables an operator to turn on or off the system 104. The desired water pressure is a water pressure generated by the water pump 224 that is selected by an operator, and is included in the desired water pressure data 216. Once the operator sets the desired water pressure, the control device 282 operates the water pump 224 to produce the desired water pressure, and controls the water pump 224 not to produce a water pressure that exceeds the desired water pressure. Further, the control device 282 operates not to allow an operator to choose a desired water pressure that exceeds a maximum water pressure that is permitted for excavation processes under a given circumstance.

The control device 272 operates to monitor the user input 280 and provide the control signal 212. In some embodiments, the control device 272 includes at least one Vansco Multiplexing Module (VMM). For example, the control device 272 can include three VMM's.

As described above, the user input 280 includes a power on/off command, which can be called a MultiFlow control input in practice. When an operator manipulates the user interface 270 (e.g., a switch of the user interface 270) to input a command to turn on the water pump control system 104 (e.g., switching on the water pump 224), the control device 272 operates to process the input and generate the control signal 212 to increase or decrease a water flow at the water pump 224, thereby adjusting a water pressure of the pressurized water 210. In some embodiments, the control signal 212 generated by the control device 272 includes one high side and one low side proportional current signals that are provided to the proportional valve 234 configured to adjust a flow of hydraulic fluid (F) into the hydraulic motor 236, which provides a driving force to the water pump 224.

Further, when an operator sets a desired water pressure through the user interface 270, the control device 272 operates to process the input and send the control signal 212 to the proportional valve 234, which then controls a flow of hydraulic fluid (F) into the hydraulic motor 236. The hydraulic motor 236 actuates the water pump 224 to produce the desired water pressure set by the operator.

The control device 272 further operates to monitor a status of the water pump circuit 202 and receive the water pump condition data 218 in real-time. In some embodiments, the water pump condition data 218 contains information about a water pressure of the water pump 224. As described below, the water pressure of the water pump 224 can be monitored by the pressure transducer 274.

As such, the control device 272 is configured to receive the user input 280 including the desired water pressure data 216 and monitor the water pump condition data 218 in real-time. The control device 272 uses the user input 280 and the water pump condition data 218 to control a current water pressure of the water pump 224 at the desired water pressure set by an operator, or at a pressure not greater than the desired water pressure. In some embodiments, the control device 272 can consider information about the digging lance 226 and/or the nozzle 228 (e.g., types and sizes) to calculate the current water pressure of the pressurized water 210 injected therefrom. Such information about the digging lance 226 and/or the nozzle 228 can be provided by an operator through the user interface 270 and included in the user input 280. An example method of operating the control device 272 is illustrated and described in more detail with reference to FIG. 6.

Figure 7:
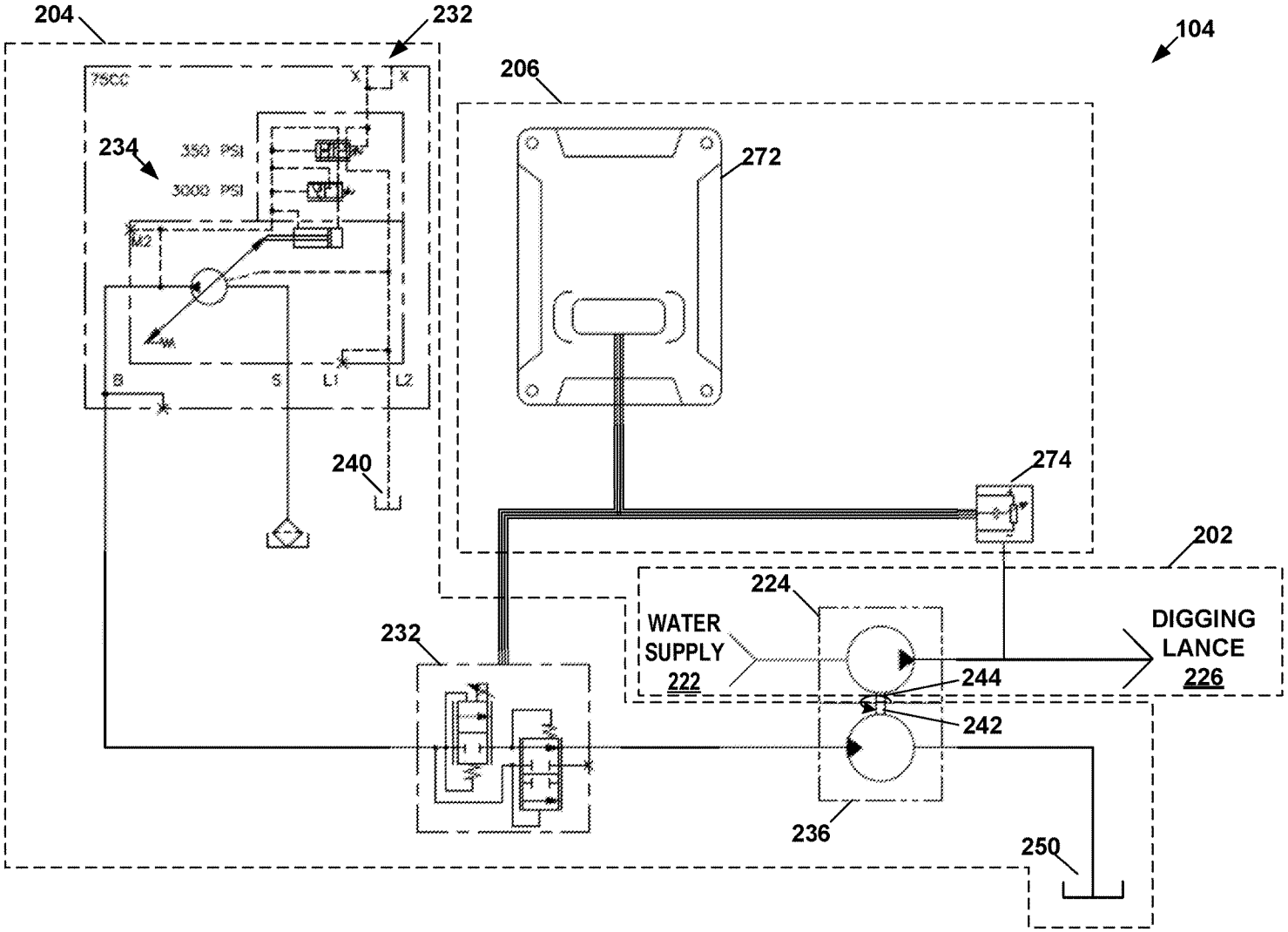
FIG. 7 is an example hydraulic circuit diagram of the water pump control system of FIG. 5.

The pressure transducer 274 is arranged and configured to detect a water pressure of the water pump 224 in real-time. In some embodiments, the pressure transducer 274 is arranged at a gage port (e.g., an outlet port) of the water pump 224, as illustrated in FIG. 7. In other embodiments, the pressure transducer 274 is configured to directly detect a pressure of the pressurized water 210 at the nozzle 228 of the digging lance 226.

In some embodiments, the pressure transducer 274 is configured to be freeze-proof and provides a control range of 0 to 5,000 psi. When the pressure transducer 274 fails, the water pump control system 104 can still operate. However, in this case, the operator should set the maximum water pressure.

Figure 6:
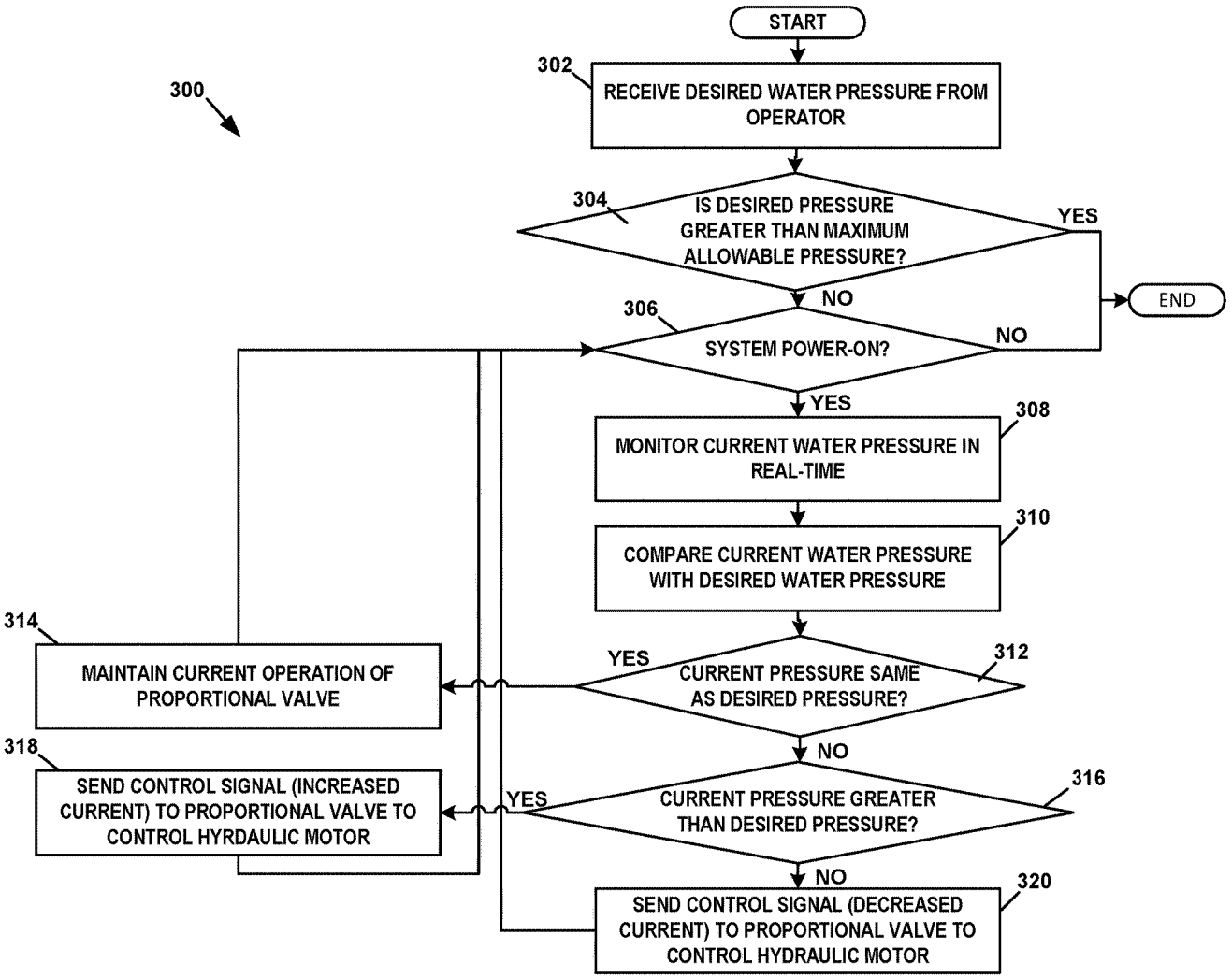
FIG. 6 is a flowchart illustrating an example method of operating a control device of FIG. 5.

FIG. 6 is a flowchart illustrating an example method 300 of operating the control device 272.

At operation 302, the control device 272 receives a desired water pressure set by an operator through the user interface 270. The desired water pressure is a water pressure of the water pump 224 that the operator wants to obtain from the water pump 224.

At operation 304, the control device 272 determines whether the desired water pressure set by the operator is greater than a maximum allowable water pressure under a subject application. The maximum allowable water pressure can be determined for operator's safety and for preventing destruction of underlying infrastructure for a particular application or circumstance and provided by various organizations, such as Gas Technology Institute (GTI), Occupational Safety and Health Administration (OSHA), and Technical Standards and Safety Authority (TSSA) in Ontario, Canada. If the desired water pressure set by the operator is greater than such a maximum allowable water pressure ("YES" at operation 304), the method ends such that the water pump circuit 202 is in inoperative condition. Otherwise ("NO" at operation 304), the method continues to operation 306.

At operation 306, the control device 272 determines whether the water pump control system 104 (e.g., the water pump circuit 202, the hydraulic actuation circuit 204, and/or the control circuit 206) is powered on or remains in operation. In some embodiments, the control device 272 monitors that the operator inputs a switch-on command through the user interface 270. If it is determined that the system is instructed to be powered on ("YES" at operation 306), the method continues on at operation 308. Otherwise ("NO" at operation 306), the method ends such that the operation of the water pump circuit 202 stops.

At operation 308, the control device 272 monitors a current water pressure of the water pump 224 in real-time through the pressure transducer 274.

At operation 310, the control device 272 operates to compare the current water pressure and the desired water pressure. In some embodiments, the current water pressure, the desired water pressure, and/or the comparison thereof can be displayed on the user interface 270 for the operator's reference. As described herein, the comparison between the current water pressure and the desired water pressure is used to generate the control signal 212 to adjust electric current that is provided to the proportional valve 234, which accordingly adjusts a flow of hydraulic fluid (F) into the hydraulic motor 236.

At operation 312, the control device 272 determines whether the current water pressure is the same as the desired water pressure. If it is determined that the current water pressure matches the desired water pressure ("YES" at operation 312), the method moves on to operation 314. Otherwise ("NO" at operation 312), the method continues to operation 316.

At operation 314, the control device 272 operates to maintain the current operation of the proportional valve 234. As a result, the operation of the water pump 224 remains consistent and does not change a pressure of the pressurized water 210. The method then returns to the operation 306.

At operation 316, the control device 272 determines whether the current water pressure is greater than the desired water pressure. If it is determined that the current water pressure is greater than the desired water pressure ("YES" at operation 316), the method moves on to operation 318. Otherwise ("NO" at operation 316), the method continues on at operation 320.

At operation 318, the control device 272 generates and sends the control signal 212 to control the proportional valve 234, which subsequently controls the hydraulic motor 236. In this case, the control device 272 can increase electric current flowing into the proportional valve 234 to increase a flow of hydraulic fluid (F) into the hydraulic motor 236, thereby speeding up the water pump 224 to increase a water pressure of the water pump 224 to meet the desired water pressure. Then, the method returns to the operation 306.

At operation 320, the control device 272 generates and sends the control signal 212 to control the proportional valve 234, which subsequently controls the hydraulic motor 236. In this case, the control device 272 can decrease electric current flowing into the proportional valve 234 to decrease a flow of hydraulic fluid (F) into the hydraulic motor 236, thereby slowing down the water pump 224 to lower a water pressure of the water pump 224 to meet the desired water pressure. Once the operation 320 is done, the method returns to the operation 306.

As such, the control device 272 operates to control electric current provided to the proportional valve 234 such that, when an operator sets a desired water pressure (not exceeding a maximum allowable pressure) through the user interface 270, the water pump 224 is operated to automatically produce the pressurized water 210 at the desired water pressure. The operator can select any level of water pressure up to the maximum allowable pressure. Further, the operator does not need to continue to press a button on the control panel 106 until a water pressure of the water pump 224 reaches the desired water pressure set by the operator. Once the maximum allowable water pressure is reached, the control device 272 does not increase electric current flowing to the proportional valve 234 to prevent the operator to increase a water pressure greater than the maximum allowable water pressure. Accordingly, the control device 272 prevents excessive flow conditions at the water pump 224. Therefore, the control circuit 206 utilizing the control device 272 and the pressure transducer 274 can eliminate an unloader and a water pressure relief that are typically used with the water pump 224 to relieve excess water pressure.

As described above, the control device 272 does not require an operator to maintain a switch or button to be depressed until the desired water pressure is reached. Once an operator simply selects a desired water pressure through the user interface 270 and input a command to turn on the system (e.g., by single or double tapping on a switch or button displayed on a touch-sensitive display screen of the user interface 270), the control device 272 operates to automatically increase electric current into the proportional valve 234 until the desired water pressure is achieved.

The control device 272 can maintain the desired water pressure of the water pump 224 regardless of whether the nozzle 228 of the digging lance 226 has different types or sizes. As described above, the control device 272 is configured to detect a current water pressure of the water pump 224 in real-time through the pressure transducer 274, compares the current water pressure with the desired water pressure, and adjust electric current flowing into the proportional valve 234 based upon the comparison to increase or decrease the water pressure of the water pump 224 to meet the desired water pressure. This process does not depend on the types or sizes of the nozzle 228. Therefore, the control device 272 does not require an operator of the system to consider the types or sizes of the nozzle 228 when operating the system. Further, the control device 272 can also compensate for both an increase in water pressure when an operator releases a trigger of the digging lance 226 and a decrease in water pressure when an operator depresses the trigger of the digging lance 226, thereby maintaining the desired water pressure.

In some embodiments, the vehicle 100 includes multiple operator stations that allow one or more operators to perform excavation processes simultaneously with water from the common water pump 224. The control device 272 can continuously monitor and maintain a water pressure from the water pump 224 regardless of whether all or some of the multiple operator stations are in use. By way of example, the vehicle 100 can have two operation stations, and two operators can manipulate the two operations in different manners. For example, the control device 272 can maintain a same desired water pressure even if the operators use different sizes of nozzles. Even if one of the operators releases a trigger of a digging lance 226, which generates excess water flow, the control device 272 can maintain such a desired water pressure and eliminate the need of an unloader valve to bypass the excess water flow. Where only one operator station has been in use and the other operator station has just been turned on, water flow can be insufficient for both operators. The control device 272 can monitor such insufficiency of water flow and automatically control the water pump 224 to a desired water pump as described above. Without the control device 272, one or both of the operators would have to manually adjust a water flow at the water pump 224 to compensate for the other operator. As such, the control device 272 can automatically compensate for pressure fluctuations of the water pump 224 resulting from actuating or releasing triggers of digging lances 226.

FIG. 7 is an example hydraulic circuit diagram of the water pump control system 104 of FIG. 5. The hydraulic circuit diagram as illustrated in FIG. 7 shows one example of the water pump control system 104. Other embodiments of the water pump control system 104 are also possible with different mechanical, electrical, and/or hydraulic components and different combinations thereof.

Figure 8:
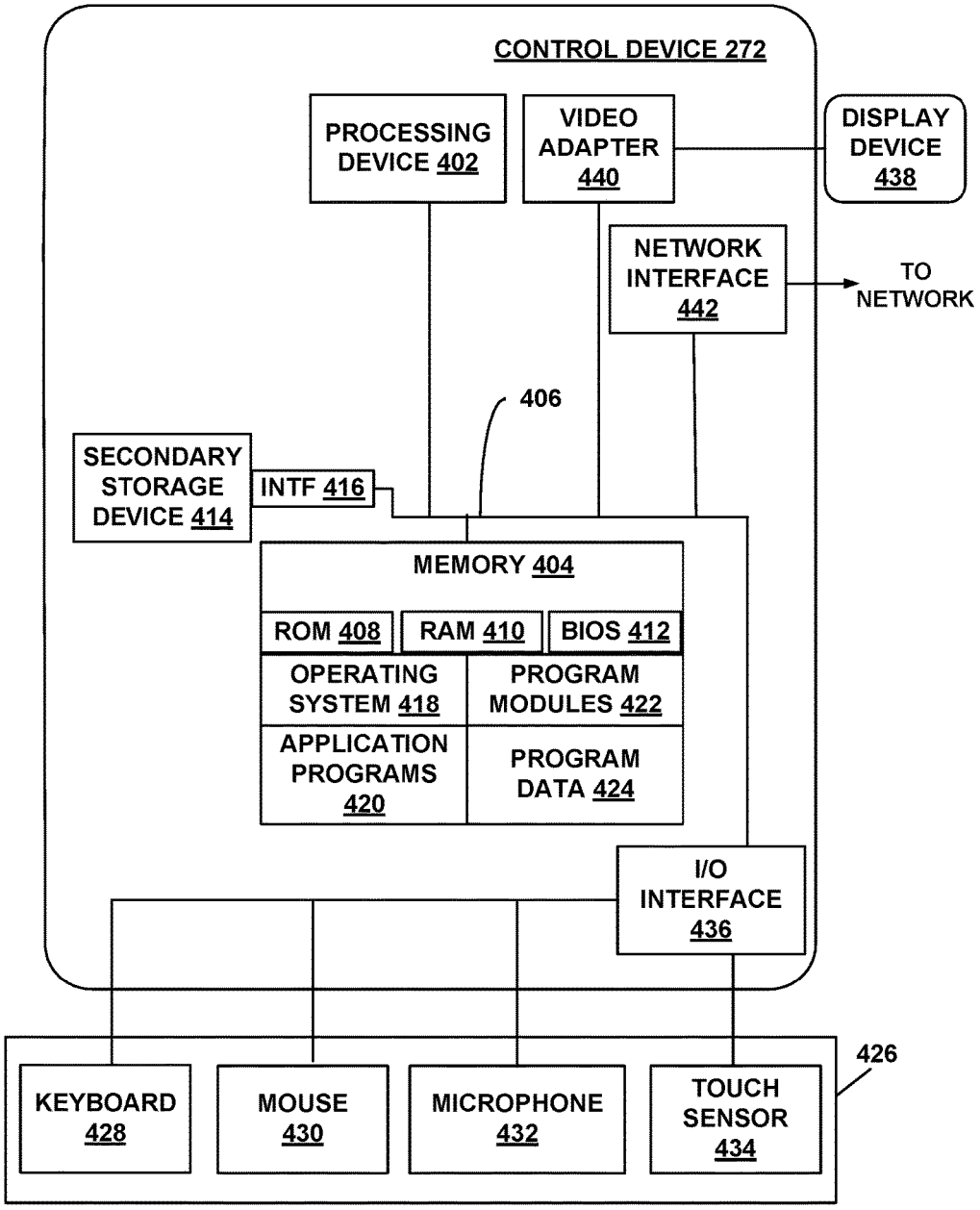
FIG. 8 illustrates an exemplary architecture of a computing device that can be used to implement aspects of the present disclosure, including the control device of FIG. 5.

FIG. 8 illustrates an exemplary architecture of a computing device that can be used to implement aspects of the present disclosure, including the control device 272. The computing device illustrated in FIG. 8 can be used to execute the operating system, application programs, and software modules (including the software engines) described herein. By way of example, the computing device will be described below as the control device 272. To avoid undue repetition, this description of the computing device will not be separately repeated herein for each of other computing devices that can be used in the water pump control system 104 and/or the vehicle 100, but such devices can also be configured as illustrated and described with reference to FIG. 8.

The control device 272 includes, in some embodiments, at least one processing device 402, such as a central processing unit (CPU). A variety of processing devices are available from a variety of manufacturers, for example, Intel or Advanced Micro Devices. In this example, the control device 272 also includes a system memory 404, and a system bus 406 that couples various system components including the system memory 404 to the processing device 402. The system bus 406 is one of any number of types of bus structures including a memory bus, or memory controller; a peripheral bus; and a local bus using any of a variety of bus architectures.

Examples of computing devices suitable for the control device 272 include a desktop computer, a laptop computer, a tablet computer, a mobile computing device (such as a smart phone, an iPod® or iPad® mobile digital device, or other mobile devices), or other devices configured to process digital instructions.

The system memory 404 includes read only memory 408 and random access memory 410. A basic input/output system 412 containing the basic routines that act to transfer information within control device 272, such as during start up, is typically stored in the read only memory 408.

The control device 272 also includes a secondary storage device 414 in some embodiments, such as a hard disk drive, for storing digital data. The secondary storage device 414 is connected to the system bus 406 by a secondary storage interface 416. The secondary storage devices 414 and their associated computer readable media provide nonvolatile storage of computer readable instructions (including application programs and program modules), data structures, and other data for the control device 272.

Although the exemplary environment described herein employs a hard disk drive as a secondary storage device, other types of computer readable storage media are used in other embodiments. Examples of these other types of computer readable storage media include magnetic cassettes, flash memory cards, digital video disks, Bernoulli cartridges, compact disc read only memories, digital versatile disk read only memories, random access memories, or read only memories. Some embodiments include non-transitory media. Additionally, such computer readable storage media can include local storage or cloud-based storage.

A number of program modules can be stored in secondary storage device 414 or memory 404, including an operating system 418, one or more application programs 420, other program modules 422 (such as the software engines described herein), and program data 424. The control device 272 can utilize any suitable operating system, such as Microsoft Windows™, Google Chrome™, Apple OS, and any other operating system suitable for a computing device.

In some embodiments, a user provides inputs to the control device 272 through one or more input devices 426. Examples of input devices 426 include a keyboard 428, mouse 430, microphone 432, and touch sensor 434 (such as a touchpad or touch sensitive display). Other embodiments include other input devices 426. The input devices are often connected to the processing device 402 through an input/output interface 436 that is coupled to the system bus 406. These input devices 426 can be connected by any number of input/output interfaces, such as a parallel port, serial port, game port, or a universal serial bus. Wireless communication between input devices and the interface 436 is possible as well, and includes infrared, BLUETOOTH® wireless technology, 802.11a/b/g/n, cellular, or other radio frequency communication systems in some possible embodiments.

In this example embodiment, a display device 438, such as a monitor, liquid crystal display device, projector, or touch sensitive display device, is also connected to the system bus 406 via an interface, such as a video adapter 440. In addition to the display device 438, the control device 272 can include various other peripheral devices (not shown), such as speakers or a printer.

When used in a local area networking environment or a wide area networking environment (such as the Internet), the control device 272 is typically connected to a data communications network through a network interface 442, such as an Ethernet interface. Other possible embodiments use other communication devices. For example, some embodiments of the control device 272 include a modem for communicating across the network.

The control device 272 typically includes at least some form of computer readable media. Computer readable media includes any available media that can be accessed by the control device 272. By way of example, computer readable media include computer readable storage media and computer readable communication media.

Computer readable storage media includes volatile and nonvolatile, removable and non-removable media implemented in any device configured to store information such as computer readable instructions, data structures, program modules or other data. Computer readable storage media includes, but is not limited to, random access memory, read only memory, electrically erasable programmable read only memory, flash memory or other memory technology, compact disc read only memory, digital versatile disks or other optical storage, magnetic cassettes, magnetic tape, magnetic disk storage or other magnetic storage devices, or any other medium that can be used to store the desired information and that can be accessed by the control device 272. Computer readable storage media does not include computer readable communication media.

Computer readable communication media typically embodies computer readable instructions, data structures, program modules or other data in a modulated data signal such as a carrier wave or other transport mechanism and includes any information delivery media. The term "modulated data signal" refers to a signal that has one or more of its characteristics set or changed in such a manner as to encode information in the signal. By way of example, computer readable communication media includes wired media such as a wired network or direct-wired connection, and wireless media such as acoustic, radio frequency, infrared, and other wireless media. Combinations of any of the above are also included within the scope of computer readable media.

The computing device illustrated in FIG. 8 is also an example of programmable electronics, which may include one or more such computing devices, and when multiple computing devices are included, such computing devices can be coupled together with a suitable data communication network so as to collectively perform the various functions, methods, or operations disclosed herein.

Figure 9:
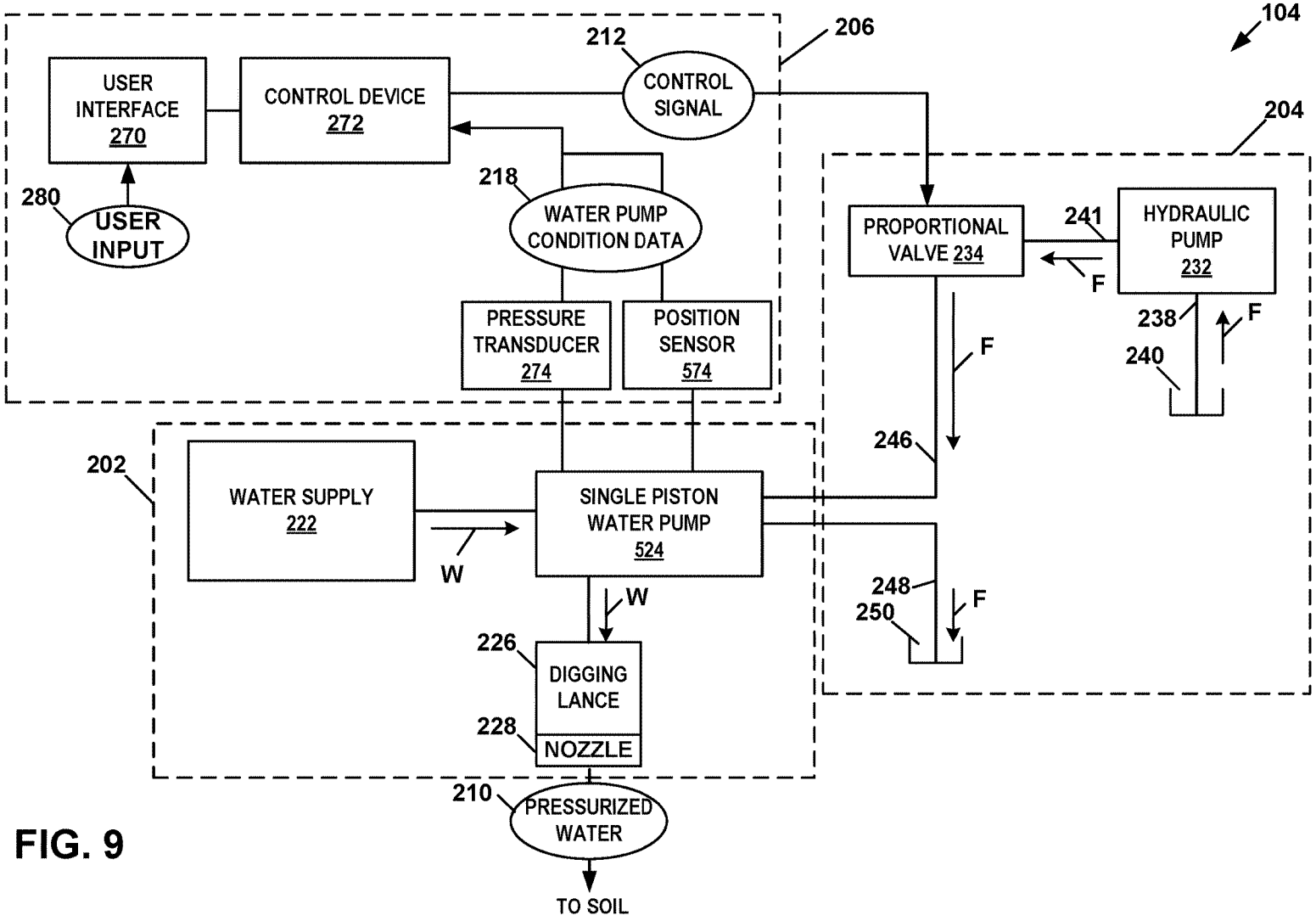
FIG. 9 a schematic diagram of another example water pump control system of FIG. 4.

FIG. 9 is a schematic diagram of another example water pump control system 104 of FIG. 4, illustrating example elements of the water pump circuit 202, the hydraulic actuation circuit 204, and the control circuit 206.

As many of the concepts and features described with reference to FIG. 9 are similar to the example shown in FIG. 5, the description with respect to FIG. 5 is hereby incorporated by reference for this example. Where like or similar features or elements are shown, the same reference numbers will be used where possible. The following description will be limited primarily to the differences from the example of FIG. 5.

In the example of FIG. 9, the water pump control system 104 includes a single piston water pump 524, which can replace the water pump 224, the hydraulic pump 236, and associated components, such as the shafts 242 and 244. As described below, the single piston water pump 524 is configured as a double-acting position reciprocating pump, while the water pump 224 in FIG. 5 is illustrated as a crankshaft driven, plunger-style reciprocating pump.

Similarly to the water pump 224, the water pump 524 operates to move water (W) from the water supply 222 to the digging lance 226. In this example, the water pump 524 includes a dual action, single piston water pump that is operated by the hydraulic actuation circuit 204. One example of the water pump 524 is a Vactor JetRodder water pump, which is available by Vactor Manufaturing (Streator, Ill.). Other water pumps can also be used in other embodiments. An example structure of the water pump 524 is illustrated below with respect to FIG. 10.

As described herein, the control circuit 206 operates to control the water pump speed by monitoring a status of the water pump 524, such as the water pressure and/or the piston position of the water pump 524, and generating the control signal 212 (e.g., electric current) transmitted to the proportional valve 234 to meet the desired water pressure set by an operator through the user interface 270. In some examples, the control signal 212 includes electric current that is adjusted and flows into the proportional valve 234. In some embodiments, the control circuit 206 includes the pressure transducer 274 for monitoring the water pressure of the water pump 524. In addition, the control circuit 206 further includes a position sensor 574. In some embodiments, the position sensor 574 includes a linear position sensor.

As such, the water pump condition data 218 can include information about the water pressure of the water pump 524 monitored by the pressure transducer 274 and about the position of the piston of the water pump 524 monitored by the piston position sensor 574.

Although the piston position sensor 574 is illustrated in FIG. 9 to be included in the control circuit 206, some embodiments of the piston position sensor 574 are attached to the water pump 224. In other embodiments, the piston position sensor 574 is disposed in other locations.

Figure 10:
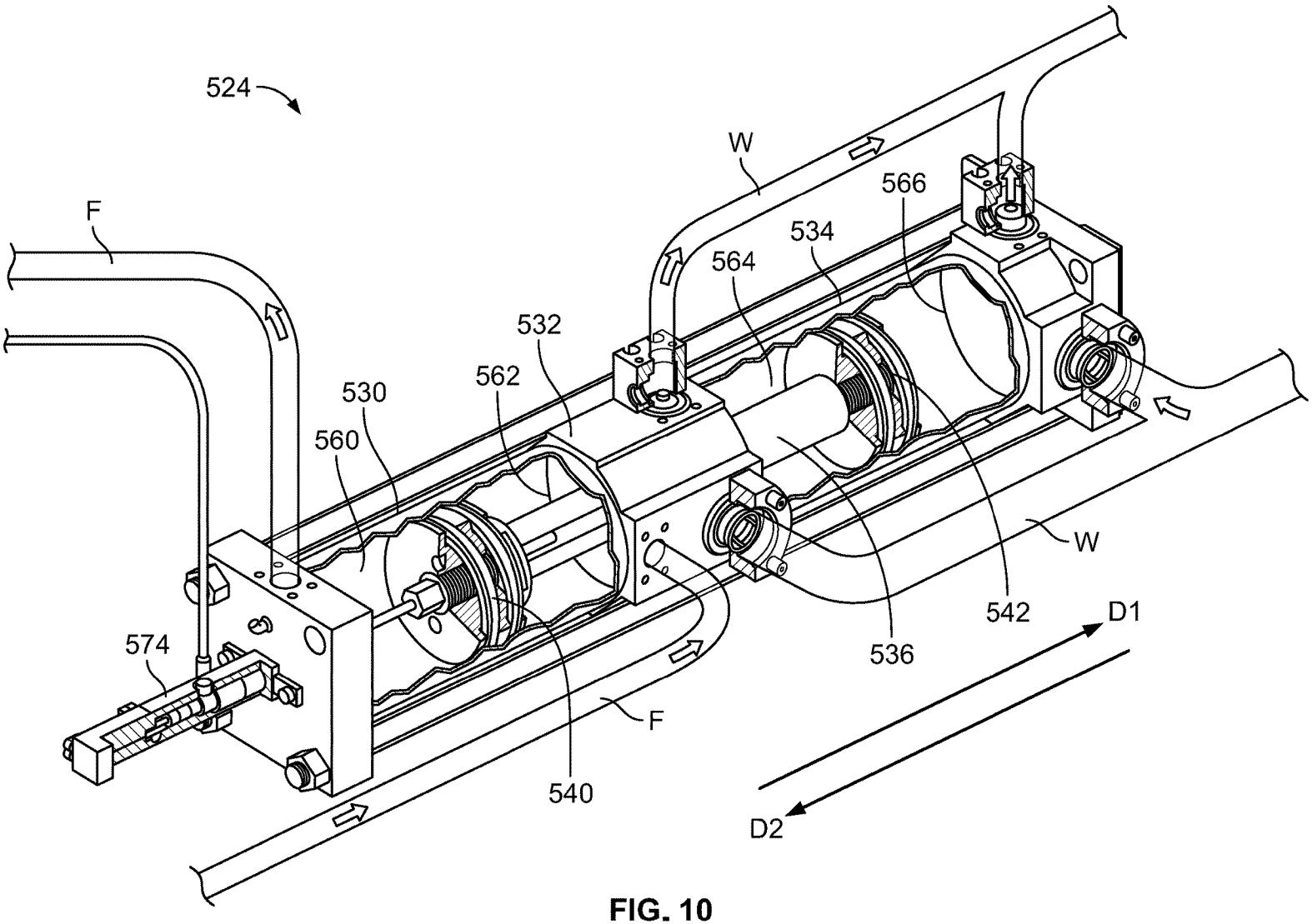
FIG. 10 is a schematic view of an example water pump of FIG. 9.

FIG. 10 is a schematic view of an example of the single piston water pump 524 of FIG. 9. In this example, the water pump 524 includes a hydraulic cylinder 530 on one side of a sealed center block 532 and a water cylinder 534 on the other side. A single shaft 536 extends between the hydraulic cylinder 530 and the water cylinder 534 through the center block 532 and is provided with two piston heads 540 and 542 at the opposite ends of the shaft 536. The shaft 536 is configured to reciprocate with a first piston head 540 disposed within the hydraulic cylinder 530 and a second piston head 542 disposed within the water cylinder 534. The first piston head 540 defines a first hydraulic chamber 560 and a second hydraulic chamber 562 within the hydraulic cylinder 530. Similarly, the second piston head 542 defines a first water chamber 564 and a second water chamber 566 within the water cylinder 534.

The pump 524 operates to constantly load and expel hydraulic oil F to/from the hydraulic cylinder 530, and accordingly load and expel water W to/from the water cylinder 534. For example, when the hydraulic fluid F is supplied to the first hydraulic chamber 560 and discharged from the second hydraulic chamber 562 of the hydraulic cylinder 530, the piston shaft 536 moves in a first direction D1, thereby discharging water from the second water chamber 566 and drawing water into the first water chamber 564 of the water cylinder 534. When the hydraulic fluid F is supplied to the second hydraulic chamber 562 and discharged from the first hydraulic chamber 560, the piston shaft 536 moves in a second direction D2 opposite to the first direction D1, thereby discharging water from the first water chamber 564 and drawing water into the second water chamber 566.

In one example, the single piston water pump 524 can accommodate the following water flows and pressures depending on a hose size.

| Flow and Pressure (GMP @ PSI) | | Hose Size (Inches) |
|---|---|---|
| 40 | 2500 | ¾ or 1 |
| 50 | 3000 | ¾ or 1 |
| 60 | 2000 | 1 |
| 60 | 2500 | 1 |
| 70 | 3000 | 1 |
| 80 | 2000 | 1 |
| 80 | 2500 | 1 |
| 100 | 2000 | 1¼ |
| 120 | 2000 | 1¼ |

The single piston water pump 524 includes a reduced number of moving elements by eliminating, such as the input and output shafts 242 and 244 as illustrated in FIG. 5. Further, the single piston water pump 524 allows a slow stroke, thereby reducing friction and providing longer field life with less maintenance.

Figure 11:
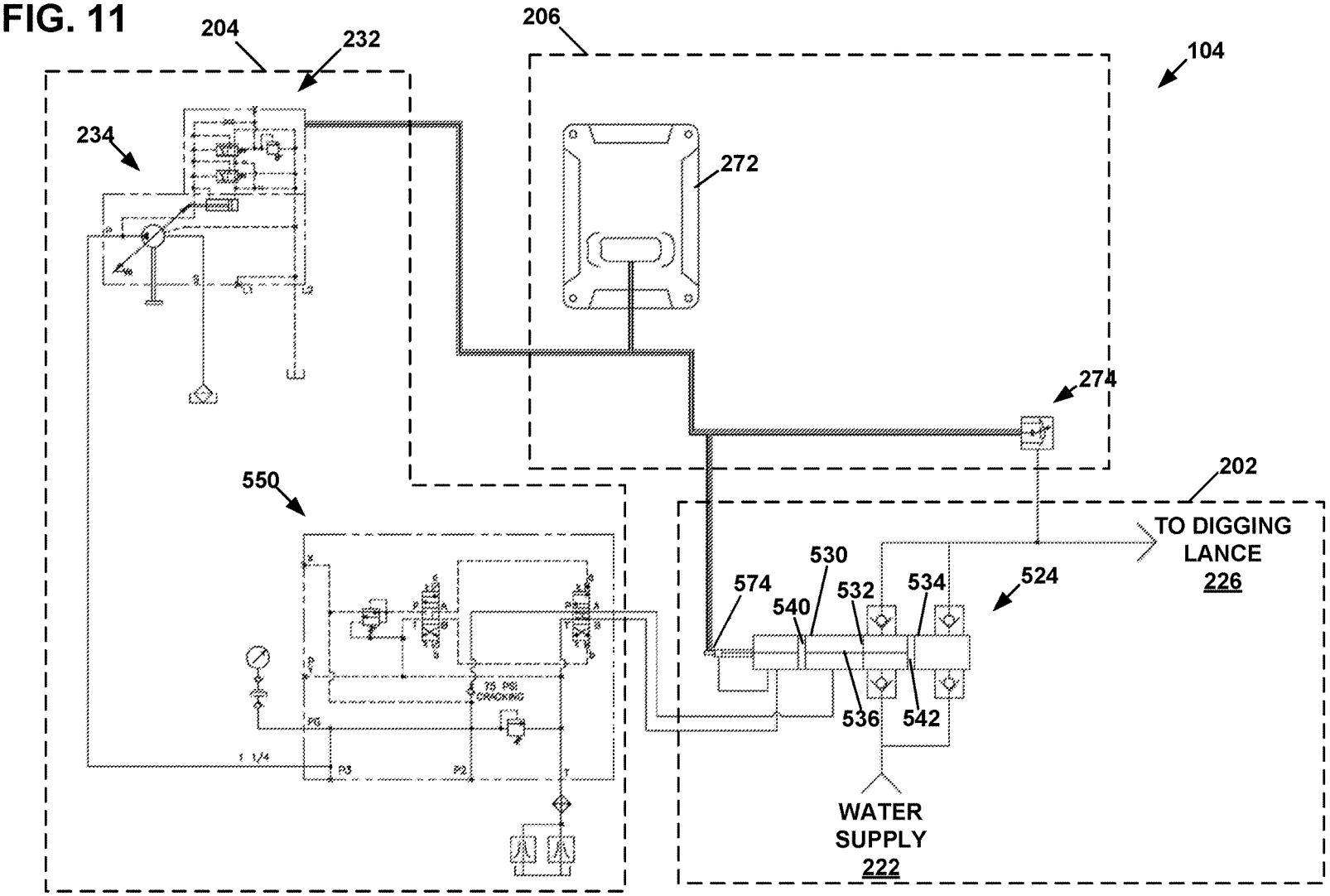
FIG. 11 is an example hydraulic circuit diagram of the water pump control system of FIG. 9.

FIG. 11 is an example hydraulic circuit diagram of the water pump control system 104 of FIG. 9. As illustrated, the water pump control system 104 can further include a pump control manifold 550 that is provided to regulate fluid flow to the single piston water pump 524.

In some embodiments, the water pump control system 104 includes an accumulator. In other embodiments, the water pump control system 104 does not include an accumulator. In some embodiments, the water pump control system 104 includes one or more unloader valves. In other embodiments, the water pump control system 104 does not include an unloader valve.

With continued reference to FIGS. 9-11, the water pump control system 104 employs a hydraulic directional control valve (e.g., the proportional valve 234) to reverse the direction of the water pump when the water pump reaches the end of its stroke. The position sensor 574, which can be configured as a linear position sensor, operates to provide feedback to the control device 272 regarding the position of the piston 536 within the water pump 524. Based on the feedback on the piston position, the control device 272 electrically actuates the directional control valve to change the direction of movement of the piston 536 within the water pump 524. The use of the position sensor 574 allows the water pump to achieve an increased stroke length while preventing the piston from hitting the end of the water pump. Hitting the end of the pump would otherwise cause pressure spikes, which are detrimental to the water system. Further, the use of the linear sensor can enable the system to obtain and present the status of water flow in real-time. This allows an operator to monitor water usage as well as the selected nozzle for excessive wear.

As described above, in accordance with an exemplary embodiment of the present disclosure, the water pump control system 104 includes the control device 282, which, in some examples, includes three Vansco Multiplexing Modules (VMM), to monitor the system inputs and provide system outputs based on the inputs. The system inputs can include a momentary switch that, when actuated (for example, up or down), sends an input to either increase or decrease the water pump flow. This input is processed by the control device and can generate an output, which, for example, includes high-side and low-side proportional current drivers. The current drivers can be connected to the proportional hydraulic valve 234 (e.g., an electro-proportional compensator), which regulates the stroke of the hydraulic pump, to produce the requested oil flow to the water pump 524. As such, an operator can use this system to set a pressure in the water pump. The system may include a pressure relief valve to relieve excess water flow in case of a failure to the electro-proportional compensator.

As described herein, the water pump control system 104 enables a user to select a desired water pressure. The system includes the user interface 270, such as a selector switch, to set a target water pressure. The system further includes the pressure transducer 274 that can be placed in a gage port of the water pump to provide real-time pressure feedback to the control device 272. The control device 272 uses the feedback to compare the actual system pressure to the target pressure. In some embodiments, the actual and target pressure readings can be displayed on the user interface 272 (e.g., a control panel display). The result of comparison can be used to control the current drivers that are connected to the electro-proportional compensator, which then provides hydraulic oil flow to the water pump 524. This control feature can limit the current to the electro-proportional compensator so that the operator can use the switch to select any pressure up to the selected pressure. Once the selected pressure has been achieved, it will not allow the operator to increase the current to the electro-proportional compensator, thereby preventing the hydraulic pump from producing more flow than what is required to achieve the requested flow. As described above, the system also employs the linear position sensor 574 that monitors the piston position to allow a maximum stroke within the pump 524.

The various examples and teachings described above are provided by way of illustration only and should not be construed to limit the scope of the present disclosure. Those skilled in the art will readily recognize various modifications and changes that may be made without following the example examples and applications illustrated and described herein, and without departing from the true spirit and scope of the present disclosure.

What is claimed is:

1. A method of controlling a water pump, the method comprising:

(a) receiving a user input of a desired water pressure for the water pump;

(b) controlling, by a controller, a hydraulic actuation circuit based on the user input to actuate the water pump at the desired water pressure;

(c) monitoring a water pressure generated by the water pump;

(d) transmitting the monitored water pressure to the controller;

(e) comparing, by the controller, the monitored water pressure with the desired water pressure;

(f) monitoring a piston position within the water pump;

(g) transmitting the monitored piston position to the controller; and (h) actuating the water pump by controlling, using the controller, a proportional valve in hydraulic actuation circuit based on the comparison and the monitored piston position to adjust the water pressure to meet the desired water pressure.

2. The method according to claim 1, wherein:

(a) the hydraulic actuation circuit comprises:

a hydraulic motor configured to actuate the water pump; and a proportional hydraulic valve configured to control the hydraulic motor, (b) controlling the hydraulic actuation circuit comprises:

sending a control signal to the proportional hydraulic valve to adjust an operation of the hydraulic motor to the water pump.

3. The method according to claim 2, wherein the control signal includes electric current.

4. The method according to claim 3, wherein sending a control signal to the proportional hydraulic valve comprises:

(a) if the water pressure is greater than the desired water pressure, decrease electric current flowing to the proportional hydraulic valve to adjust the operation of the hydraulic motor to lower a water pressure generated by the water pump to meet the desired water pressure; and (b) if the water pressure is lower than the desired water pressure, increase electric current flowing to the proportional hydraulic valve to adjust the operation of the hydraulic motor to increase a water pressure generated by the water pump to meet the desired water pressure.

5. The method according to claim 1, wherein the water pump includes a single piston water pump, the single piston water pump comprising:

a hydraulic cylinder;

a water cylinder;

a center block disposed between the hydraulic cylinder and the water cylinder; and a piston shaft extending between the hydraulic cylinder and the water cylinder through the center block, the piston shaft configured to reciprocate within the single piston water pump to receive hydraulic fluid to the hydraulic cylinder and discharge hydraulic fluid from the hydraulic cylinder, thereby discharging water from the water cylinder and receiving water from the water cylinder.

6. The method according to claim 5, wherein controlling the hydraulic actuation circuit comprises sending a control signal to the proportional hydraulic valve to control the hydraulic fluid flow to the hydraulic cylinder of the single piston water pump.

7. The method according to claim 6, wherein the control signal includes electric current, and wherein sending a control signal to the proportional hydraulic valve comprises:

(a) if the water pressure is greater than the desired water pressure, decrease electric current flowing to the proportional hydraulic valve to adjust the hydraulic fluid flowing into the hydraulic cylinder of the single piston water pump to lower a water pressure generated by the water pump to meet the desired water pressure; and (b) if the water pressure is lower than the desired water pressure, increase electric current flowing to the proportional hydraulic valve to adjust the hydraulic fluid flowing into the hydraulic cylinder of the single piston water pump to increase a water pressure generated by the water pump to meet the desired water pressure.

8. The method according to claim 1, wherein monitoring a water pressure generated by the water pump comprises monitoring a water pressure generated by the water pump through a pressure transducer mounted to the water pump.

9. The method according to claim 1, wherein the desired water pressure is not greater than a maximum water pressure required by one or more industrial standards.

10. The method according to claim 1, further comprising monitoring a pressure of a hydraulic fluid used to operate the water pump.

11. The method according to claim 1, wherein the water pump is configured as a single piston water pump.

* * * * *